US005573085A

United States Patent [19]

Galeazzi et al.

[11] Patent Number: 5,573,085

[45] Date of Patent: Nov. 12, 1996

[54] WASTE COLLECTION DEVICE

[76] Inventors: Giancarlo Galeazzi, Via Roma 76-46049, Volta Mantovana (Province of Mantova); Angelo Fusaro, Via Roma 78- 46049, Volta Mantovana (Province of Mantova), both of Italy

[21] Appl. No.: 297,278

[22] Filed: Aug. 29, 1994

[30] Foreign Application Priority Data

Sep. 7, 1993 [IT] Italy ..... MN93A0015

[51] Int. Cl.[6] ..... B66B 13/24

[52] U.S. Cl. ..... 187/337; 220/484

[58] Field of Search ..... 187/337, 338, 187/414; 220/409, 484; 248/132; 312/272

[56] References Cited

U.S. PATENT DOCUMENTS 2,528,056 10/1950 Henry ..... 220/17

3,708,085 1/1973 Bumpas ..... 220/484

FOREIGN PATENT DOCUMENTS 0480326 4/1992 European Pat. Off. .

1928618 12/1970 Germany .

1931163 1/1971 Germany .

9304085 8/1993 Germany .

*Primary Examiner*—Kenneth Noland

[57] ABSTRACT

Waste collection device that includes a pit provided with a lid that has waste insertion pillars and with a lifting unit that is suitable to move at least one waste container; the device is characterized in that the monolithic lid is pivoted to the edge of the pit and is kinematically connected to the lifting unit so as to perform the opening and closing motions respectively during the ascending and descending movements of the lifting unit.

3 Claims, 4 Drawing Sheets

WASTE COLLECTION DEVICE

BACKGROUND OF THE INVENTION

The invention relates to a waste collection device.

It is known that collection of municipal solid waste performed by means of roadside containers entails considerable disadvantages from the aesthetic and hygienic viewpoints as well as due to the space occupied by these containers.

In order to obviate these drawbacks, devices have been devised in which the waste containers are stored in a pit which is closed at the top by a lid which has pillars for the insertion of waste; the containers are caused to rise from the pit only when they must be emptied.

These devices have excellent functionality, but new studies have led to the creation of the device to which the present invention relates.

SUMMARY OF THE INVENTION

The aim of said device is to maximally facilitate the operations for emptying the containers, particularly when they are handled automatically by devices connected to the collection trucks with a single operator on board.

The aim is achieved by a waste collection device according to the invention, which comprises a pit provided with a lid that is openable and walkable in closed position at the level of the surrounding paving, said lid being associated with the upper edge of said pit and furthermore having a lifting unit that is suitable to move at least one waste container, which rests on a platform included in said lifting unit, from a position in which it is fully inserted in the pit to a position in which it is fully extracted from it, characterized in that said lid, which is provided with at least one pillar to allow users to insert waste into the at least one container, has a monolithic configuration, is pivoted to the edge of the pit at one of the sides, and is kinematically connected to said lifting unit so as to perform the opening and closing motions respectively during the ascending and descending movements of the lifting unit.

BRIEF DESCRIPTION OF THE DRAWINGS

The characteristics and advantages of the invention will become apparent from the following detailed description of a preferred but not exclusive embodiment thereof, illustrated only by way of non-limitative example in the accompanying drawings, wherein.

DESCRIPTION OF THE DRAWINGS

Figure 1:
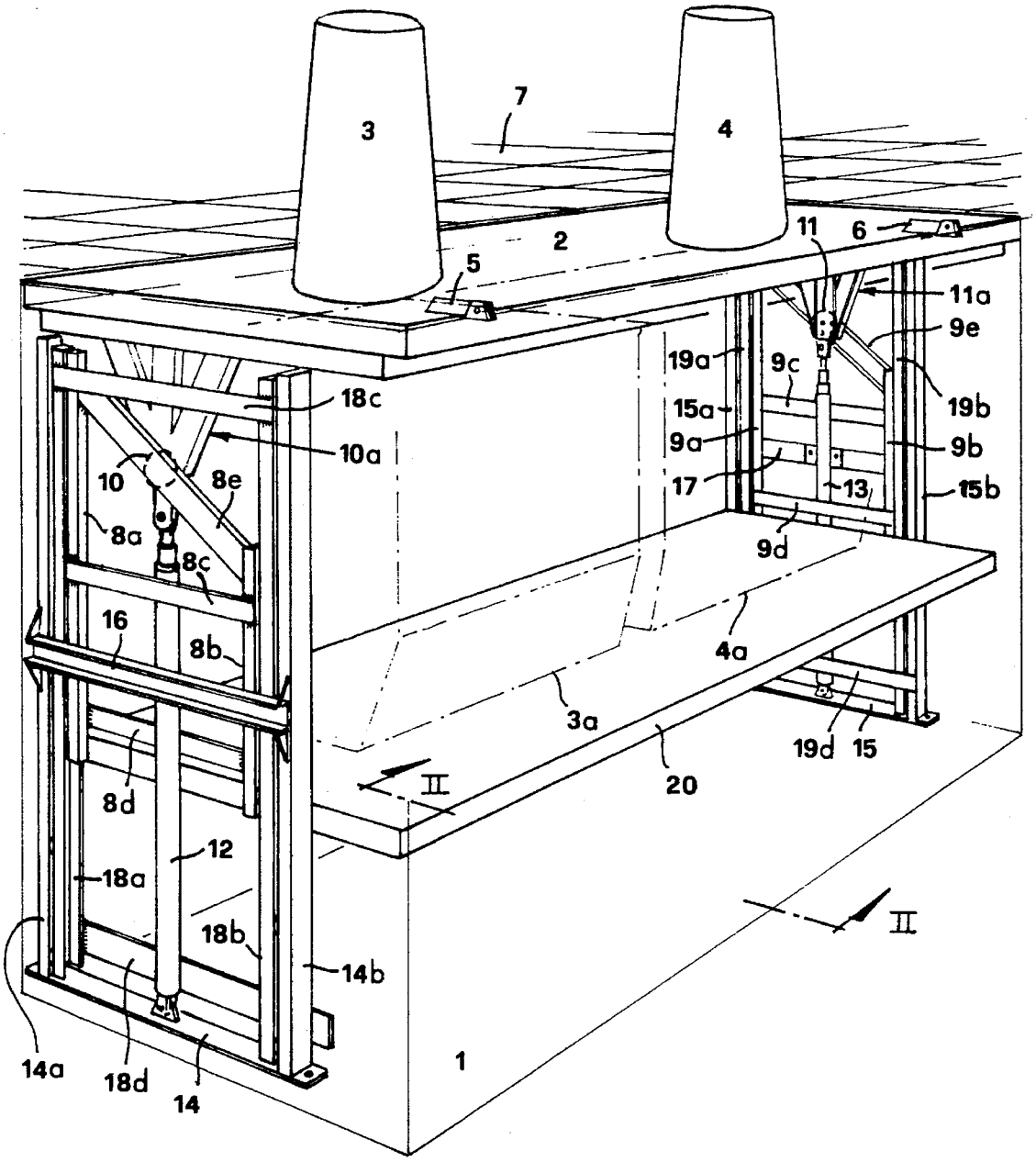
FIG. 1 is a perspective view of the device according to the invention, with the lid closed and the lifting unit at its lower stroke limit.

With reference to the above figures, the reference numeral 1 designates a pit provided with a monolithic lid 2 that comprises pillars 3 and 4 that allow users to insert the waste, optionally in bags, respectively into containers, designated by the reference numerals 3*a* and 4*a*, which will be described hereinafter.

Said lid is pivoted to the upper edge of the pit at 5 and 6, and is kinematically connected to a lifting unit contained in the pit, which will be described hereafter, so as to move between the closed position shown in FIGS. 1 and 2, at the level of the paving 7 that surrounds the pit 1, and the fully open position shown in FIG. 4.

The lifting unit contained in the pit 1 thus comprises a first section which is constituted by two sliders which are formed respectively by uprights 8*a* and 8*b*, connected by cross-members 8*c* and 8*d*, and by the uprights 9*a* and 9*b*, connected by cross-members 9*c* and 9*d*.

A guide 8*e* is rigidly coupled to the first slider and is inclined with respect to the vertical direction of the motion; a wheel 10 runs inside said guide and is rigidly coupled to the lid 2 by means of a support 10*a*; a guide 9*e* is rigidly coupled to the second slider and is inclined like 8*e*, and a wheel 11 runs inside said guide 9*e* and is rigidly coupled to the lid 2 by means of a support 11*a*; this kinematic linkage causes each vertical movement of the sliders that form the first section to be matched by a rotation of the lid 2.

Said sliders that constitute the first section have actuation means which are respectively constituted by actuation cylinders 12 and 13, the end of whose stem is indeed connected to the inclined guides 8*e*, 9*e*; said actuation cylinders rest respectively on bases 14 and 15 which are fixed to the bottom of the pit 1 and from which fixed uprights 14*a*, 14*b* and 15*a*, 15*b* rise, and are fixed to cross-members 16 and 17 that respectively connect said fixed uprights 14*a*, 14*b* and 15*a*, 15*b*.

In addition to the first described section, the lifting unit comprises a second section which is constituted by two sliders formed respectively by uprights 18*a* and 18*b*, connected by cross-members 18*c* and 18*d*, and by uprights 19*a* and 19*b*, connected by cross-members 19*c* and 19*d*; the platform 20 for supporting the waste containers 3*a* and 4*a* is rigidly coupled to said sliders.

The uprights 18*a*, 18*b* constitute the guides for the sliding of the uprights 8*a* and 8*b* and slide with respect to the fixed uprights 14*a*, 14*b*; in turn, the uprights 19*a*, 19*b* constitute the guides for the sliding of the uprights 9*a* and 9*b* and slide with respect to the fixed uprights 15*a*, 15*b*.

In terms of the functionality of the invention it is important to consider the fact that the cross-member 8*c* of a slider of the first section lies in the same plane as the cross-member 18*c* of a slider of the second section, and that in a similar manner the cross-member 9*c* lies in the same plane as the cross-member 19*c*.

While postponing further details to the description of operation, it is now sufficient to note that in this manner said cross-members 8*c* and 9*c* act as abutment elements which are suitable to make contact with complementarily shaped elements constituted by the cross-members 18*c* and 19*c* after a first part of the ascending motion to disengage from them before the last part of the descending motion.

Figure 2:
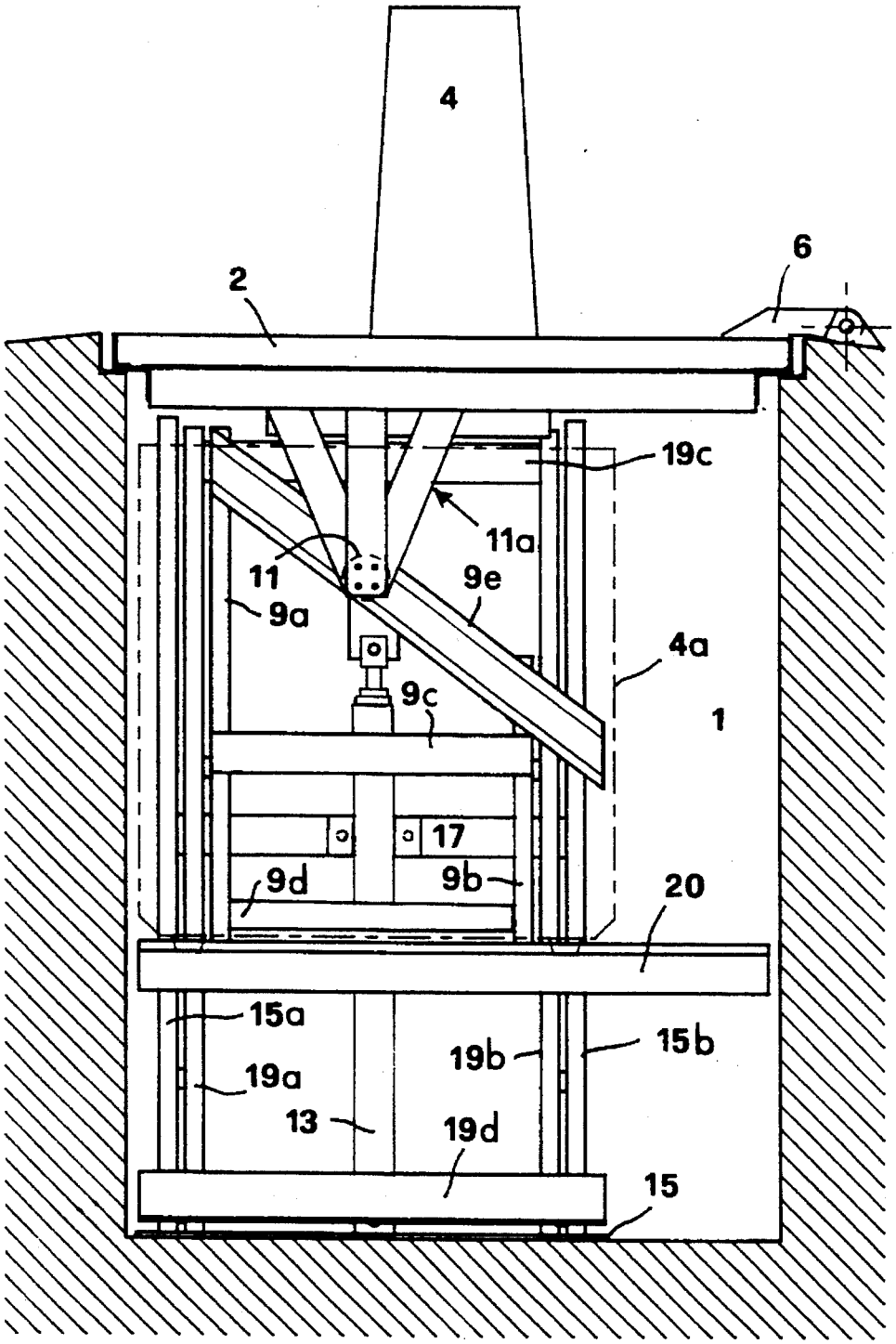
FIG. 2 is a sectional view, taken along the plane II—II of FIG. 1.

The operation of the invention is now described starting from the position shown in FIGS. 1 and 2.

When it is necessary to make the containers 3*a*, 4*a* rise from the pit to empty them, the actuation cylinders 12 and 13 are activated and in a first part of the extension of their stem simply cause the ascent of the first section of the lifting unit, i.e. of the section that comprises the sliders with the inclined guides 8*e* and 9*e*, so that at the same time the lid 2 starts to rise, while the container supporting platform 20 is motionless, thus preventing the containers 3*a*, 4*a* from colliding against the lid 2, as would occur if they started to rise together with the lid.

At a certain point during the ascending motion of the first section, the lid is open enough to allow the containers 3*a*, 4*a* to start to rise without problems; at this point the cross-members 8*c* and 9*c* of the sliders of said first section make contact with the lower edge of the crossmembers 18*c* and 19*c* of the second section, which comprises the container supporting platform 20.

Figure 3:
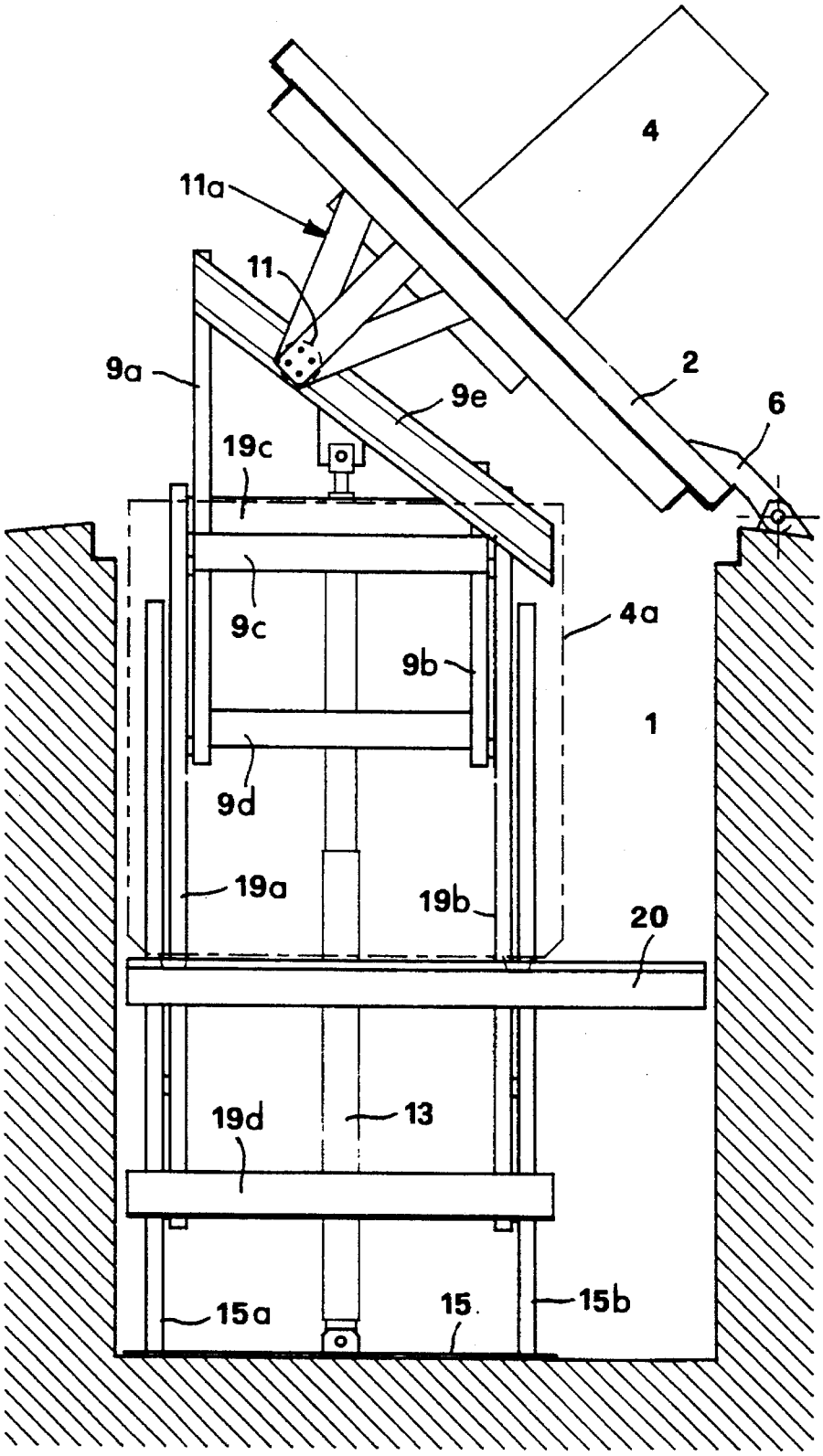
FIGS. 3 and 4 are views, similar to FIG. 2, of the device according to the invention with the lid and the lifting unit respectively in an intermediate position of their stroke and at the upper stroke limit.
Figure 4:
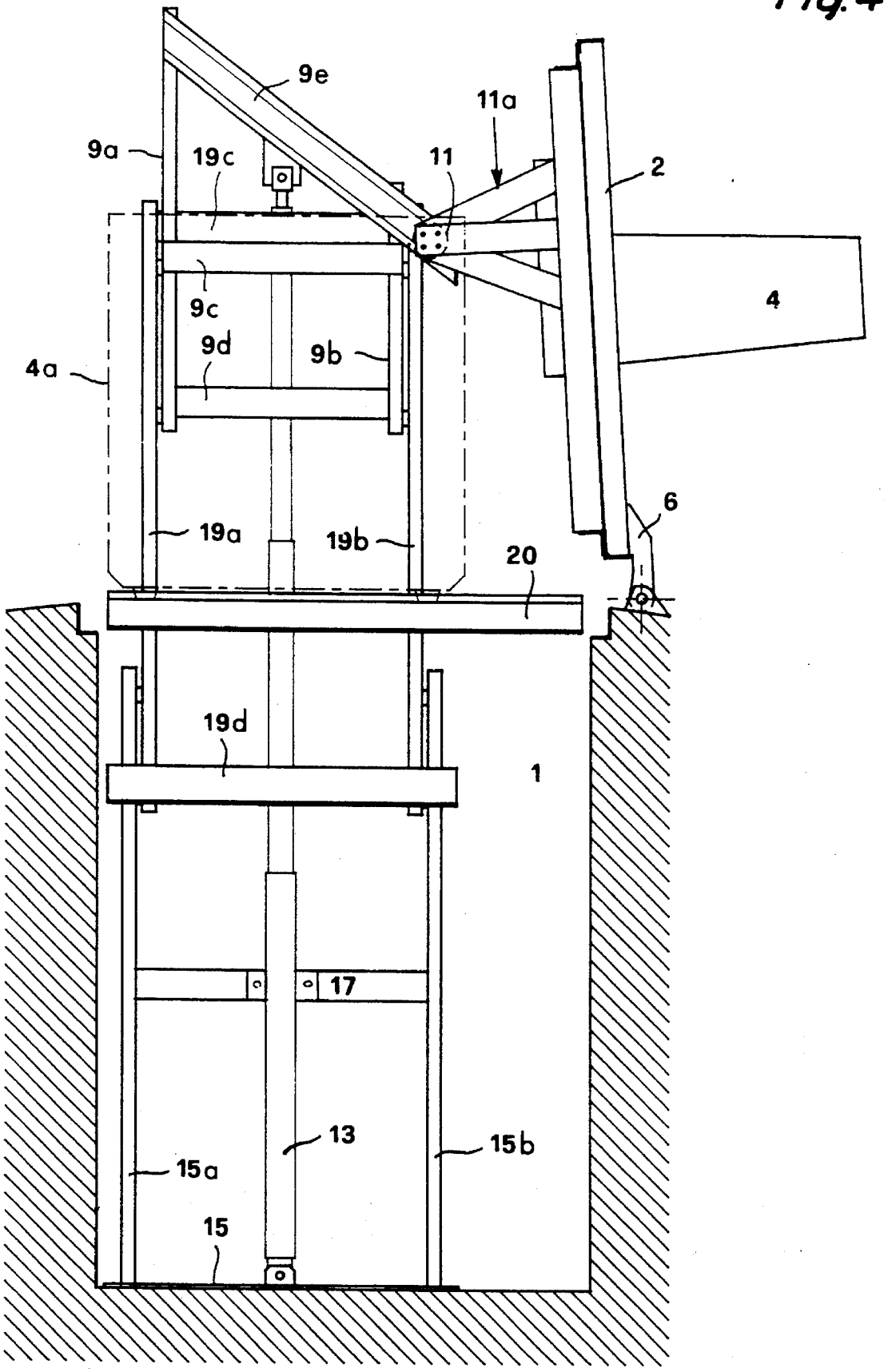

In this manner, said section is moved upwards, as shown in FIG. 3, until the position shown in FIG. 4 is reached, with the lid completely open and the platform 20 at the level of the paving that surrounds the pit 1.

During the descending motion, the two sections move together until the uprights 18*a*, 18*b* and 19*a*, 19*b* of the second section rest on the bases 14 and 15 and stop, whereas the downward motion of the first section continues, losing contact between the cross-members 8*c* and 18*c* and between the cross-members 9*c* and 19*c*, in order to complete the closure of the lid.

The described invention is susceptible to numerous modifications and variations, all of which are within the scope of the inventive concept; all the details may furthermore be replaced with other technically equivalent elements.

In the practical embodiment of the invention, the materials employed, as well as the shapes and dimensions, may be any according to the requirements.

What is claimed is:

1. Waste collection device comprising a pit provided with a lid that is openable and walkable in closed position at the level of the surrounding paving, said lid being associated with the upper edge of said pit and furthermore having a lifting unit that is suitable to move at least one waste container, which rests on a platform included in said lifting unit, from a position in which it is fully inserted in the pit to a position in which it is fully extracted from it, wherein said lid, which is provided with at least one pillar to allow users to insert waste into the at least one container, has a monolithic configuration, is pivoted to the edge of the pit at one of the sides, and is kinematically connected to said lifting unit so as to perform the opening and closing motions respectively during the ascending and descending movements of the lifting unit, wherein said lifting unit comprises means which are suitable to cause at least part of the rising motion of the lid before the ascending motion of the platform that supports the at least one waste container has begun, and to complete the closing motion of the lid only after said platform has reached the lower stroke limit.

2. Device according to claim 1, wherein said lifting unit comprises a first section that has actuation means and is connected to the lid so that each movement thereof is matched by a movement of said lid, said first section being suitable to move rigidly with a second section, which has a platform for supporting at least one container, only above a certain level with respect to the lower stroke limit.

3. Device according to claim 2, wherein the first section of the lifting unit has guides, which are inclined with respect to the direction of motion and are associated with wheels rigidly coupled to the lid, and has abutment elements which are suitable to make contact with complementarily shaped elements which are rigidly coupled to the second section only after a first portion of the ascending motion to disengage them before the last portion of the descending motion, so as to move said second section during contact.

* * * * *